United States Patent [19]

Gould

[11] 4,301,705

[45] Nov. 24, 1981

[54] CAPODASTROS

[76] Inventor: Terence Gould, The Old Crown, Bugbrooke, Northampton, England

[21] Appl. No.: 122,997

[22] Filed: Apr. 11, 1980

[30] Foreign Application Priority Data

Mar. 2, 1979 [GB] United Kingdom ..... 07367/79

[51] Int. Cl.[3] ..... G10D 3/04

[52] U.S. Cl. ..... 84/318

[58] Field of Search ..... 84/318

[56] References Cited

U.S. PATENT DOCUMENTS 1,518,719 12/1924 Whiteman ..... 84/318

4,128,034 12/1978 Myerson et al. ..... 84/318

*Primary Examiner*—Lawrence R. Franklin

[57] ABSTRACT

A capodastro for stringed musical instruments adapted for use on both flat fingerboards and transversely convex fingerboards, having a bar C adapted to press strings B onto fingerboard F, and means of attachment D around neck A of the instrument, the bar consisting principally of flexible pad H having grooves L1, not visible in FIG. 5, and L2 along its two long vertical faces in which grooves are located the long edges of hollow frame J, one of which long edges, not visible in FIG. 5, is continuous, and the other long edge K is discontinuous. When mounted on a flat fingerboard the continuous edge maintains a straight configuration. On a transversely convex fingerboard the two portions K1 and K2 of the discontinuous edge adopt an angle to each other which is compatible with the maintenance of equal pressure by said pad H over all the strings. The two portions K1 and K2 of the discontinuous edge may be either straight or curved.

1 Claim, 5 Drawing Figures

CAPODASTROS

A capodastro is a device used on the fingerboards of stringed musical instruments such as guitars and banjos. It is similar in effect to a clamp which fits around the neck of the instrument and which presses the strings firmly onto the fingerboard at any desired position, so that the portion of the strings which vibrates upon plucking is effectively shortened, and the pitch raised.

In order to achieve this purpose a capodastro consists principally of a member which acts as a pressure bar across the strings, and of means of attachment around the neck of the instrument.

Some stringed instruments have fingerboards with flat surfaces, and some have fingerboards with transversely convex surfaces. The degree of curvature of a convex fingerboard, while not great, is sufficient to preclude the maintenance of equal pressure over all the strings by a capodastro the bar of which is straight.

Players possessing both kinds of instrument normally employ a separate capodastro for each kind, one having a flat bar for the flat fingerboard instrument, and one having a curved bar for the convex fingerboard instrument.

One object of my invention is to provide a capodastro which is of simple construction and which employs inexpensive component parts.

A second object of my invention is to provide a capodastro which has a bar which is adapted to be effective on both flat and convex fingerboards, and which can be detached from a flat fingerboard and mounted on a convex fingerboard, or vice versa, without the player needing to make any mechanical alteration to the bar nor any rearrangement of its constituent parts.

These and other objects and advantages of my invention will be apparent from the following description in relation to the accompanying drawing, wherein FIG. 1 is a view in perspective of part of the neck of a stringed musical instrument, with a capodastro mounted in place.

Figure 1:
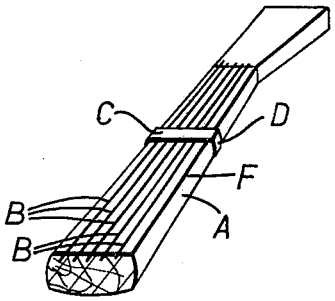

Referring more particularly to the drawings, part of neck A of a stringed musical instrument is shown in perspective in FIG. 1, having fingerboard F and any number of strings B. A capodastro is mounted in place, having bar C and strap D.

Figure 2:
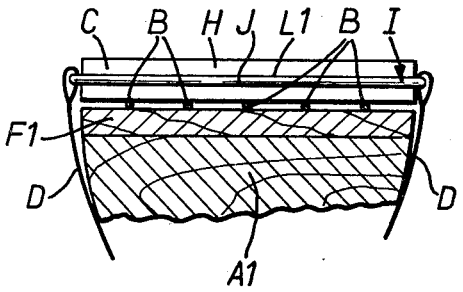
FIG. 2 is a partial cross-sectional view of the neck of an instrument having a flat fingerboard, with my capodastro mounted in place.

A partial transverse cross-section of neck A1 of an instrument is shown in FIG. 2, wherein bar C is held firmly in place by strap D. Bar C presses strings B firmly onto flat fingerboard F1.

Figure 3:
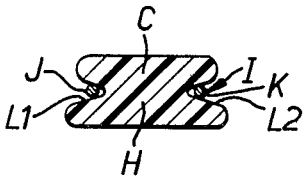
FIG. 3 is a cross-sectional view of the bar of my capodastro.

In FIG. 3 a transverse cross section of bar C is shown, wherein sides J and K of hollow frame I located firmly within channels L1 and L2 respectively of flexible pad H.

Pad H may be made of any flexible material, being most conveniently a rubber or thermoplastic or thermosetting moulding or extrusion. Hollow frame I may be made of any convenient material such as shaped metal wire or it may be a thermoplastic or thermosetting moulding.

Figure 4:
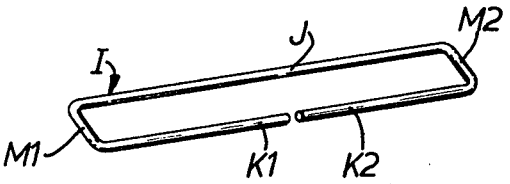
FIG. 4 is a view in perspective of one version of the hollow frame which supports the pressure pad of my capodastro.

In FIG. 4 one version of frame I is shown in perspective having one long side J which is straight and continuous, and an opposite, generally parallel, long side K which is in two portions, K1 and K2. The discontinuity in side K may most conveniently be arranged approximately half-way along that side.

Short sides M1 and M2 may be straight or curved.

Portions K1 and K2 may be straight or may be curved to complement the convexity of a convex fingerboard.

When mounted on a flat fingerboard, as shown in FIG. 2, side J, being continuous and straight, maintains a straight configuration and presses pad H equally onto all the strings.

Figure 5:
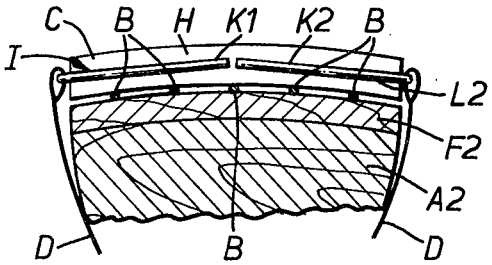
FIG. 5 is a partial cross-sectional view of the neck of an instrument having a transversely convex fingerboard, with my capodastro mounted in place.

When mounted on a transversely convex fingerboard as shown in FIG. 5 portions K1 and K2 adopt an angle to each other which is compatible with the maintenance of equal pressure by pad H on all the strings. Pad H is of a material which possesses the degree of flexibility required to perform its task, both when in a straight and when in a curved configuration.

Due to the novel structure of bar C, and in particular to the nature and form of pad H and frame I, my invention as described above is capable of being used to perform the tasks of a capodastro in an improved manner.

What I claim is:

1. A capodastro for stringed musical instruments having a pressure bar which is adapted to be effective on both flat fingerboards and on transversely convex fingerboards, which bar has a flexible pressure pad located within a hollow frame of wire or other convenient material, of which frame one opposite pair of generally parallel sides consists of one side which is straight and continuous and of another side which is discontinuous.

* * * * *